US006874471B2

(12) United States Patent
Hoshino et al.

(10) Patent No.: US 6,874,471 B2
(45) Date of Patent: Apr. 5, 2005

(54) METHOD AND APPARATUS FOR CONTROLLING MOTOR DRIVE TYPE THROTTLE VALVE

(75) Inventors: Masatoshi Hoshino, Tsuchiura (JP); Tetsuya Ichihashi, Hitachinaka (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 40 days.

(21) Appl. No.: 10/245,590

(22) Filed: Sep. 18, 2002

(65) Prior Publication Data

US 2003/0226542 A1 Dec. 11, 2003

(30) Foreign Application Priority Data

Jun. 10, 2002 (JP) ..... 2002-168005

(51) Int. Cl.[7] ..... F02D 9/02; F02D 11/10

(52) U.S. Cl. ..... 123/399

(58) Field of Search ..... 123/361, 396, 123/399

(56) References Cited

U.S. PATENT DOCUMENTS 6,523,522 B1 * 2/2003 Costin ..... 123/399

FOREIGN PATENT DOCUMENTS

| | | |
|---|---|---|
| JP | 6-101550 | 4/1994 |
| JP | 7-332136 | 12/1995 |
| JP | 10-047135 | 2/1998 |
| JP | 10-238370 | 9/1998 |
| JP | 2001-073817 | 3/2001 |
| WO | WO99/53182 | 10/1999 |

* cited by examiner

*Primary Examiner*—Tony M. Argenbright
(74) *Attorney, Agent, or Firm*—Crowell & Moring LLP

(57) ABSTRACT

When the position of a throttle valve approaches a target value, an integration calculation of position control is stopped. When a deviation from the target value increases, the integration calculation is restarted. If an integration value includes no frictional amount, a motor output in which a motor and a spring are matched is set synchronously with a change in target value.

7 Claims, 10 Drawing Sheets

FIG. 10
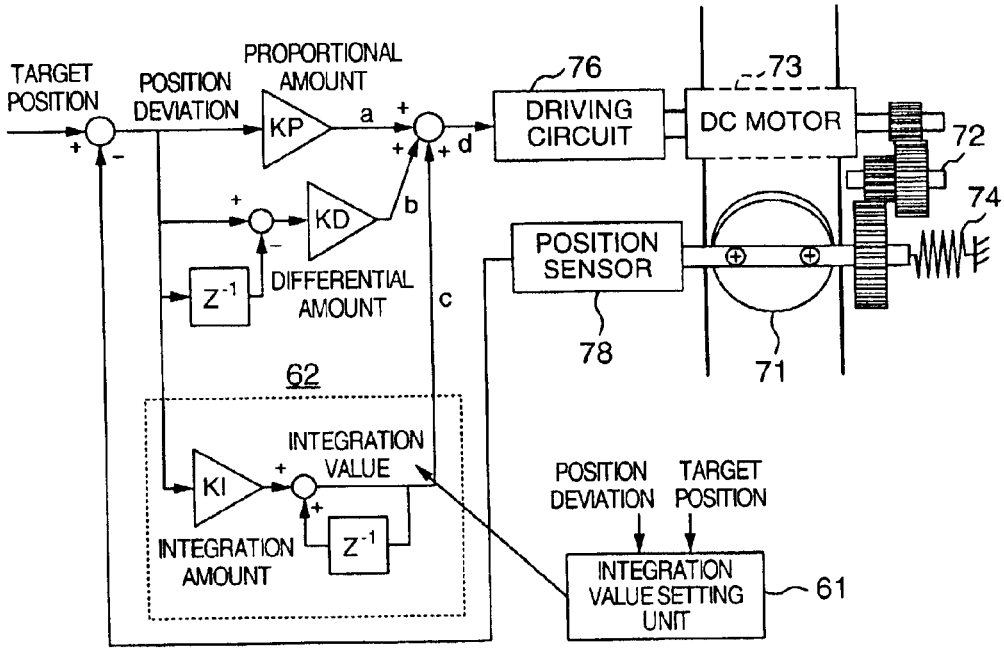
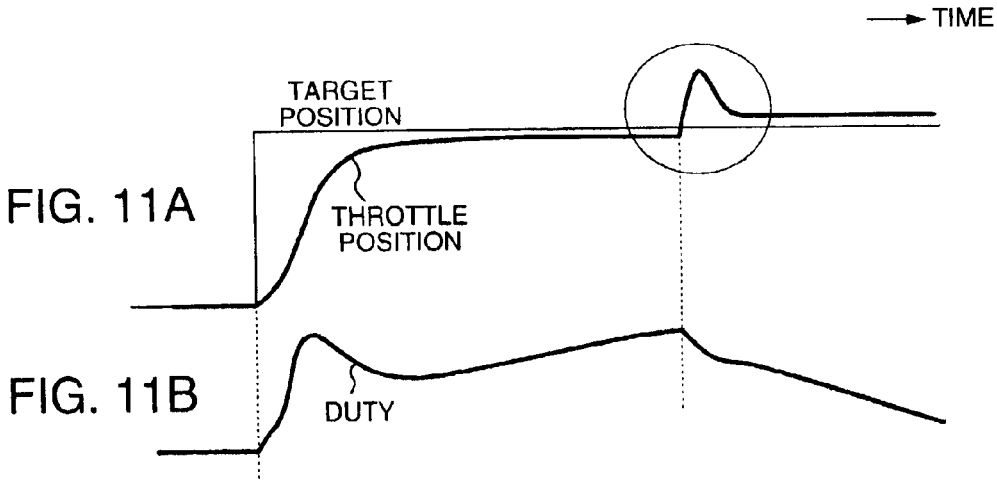

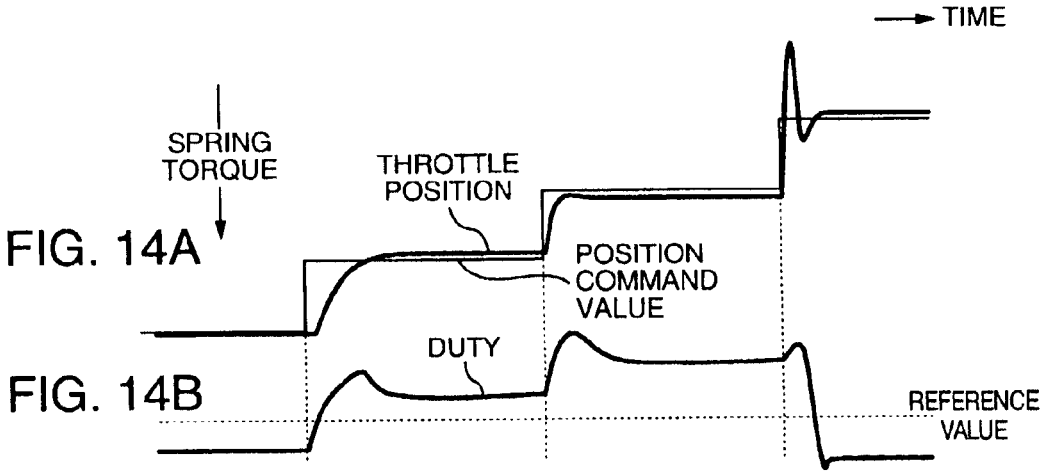
FIG. 14A
FIG. 14B
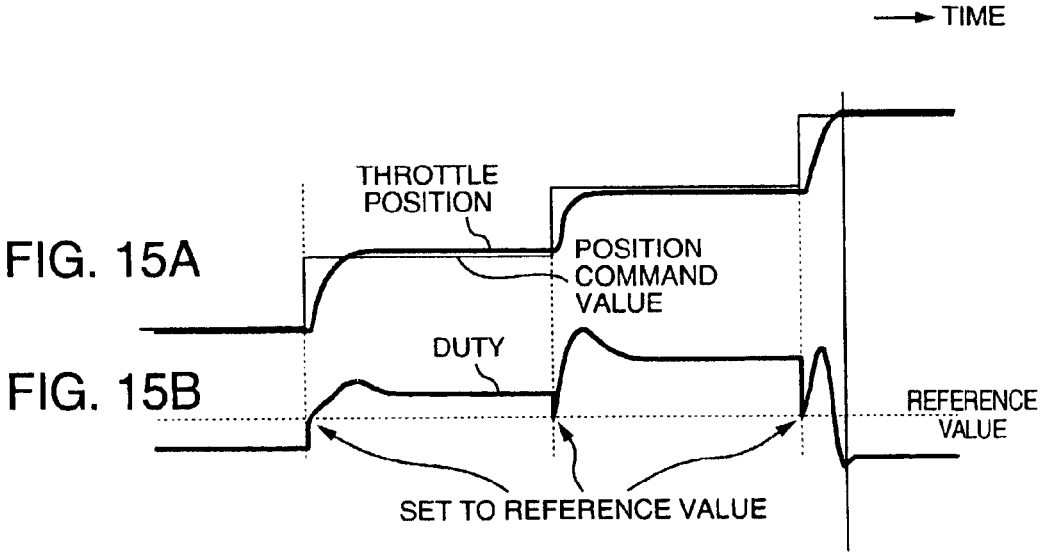
FIG. 15A
FIG. 15B

METHOD AND APPARATUS FOR CONTROLLING MOTOR DRIVE TYPE THROTTLE VALVE

BACKGROUND OF THE INVENTION

The invention relates to a method and an apparatus for electronically controlling a throttle valve by a motor and, more particularly, to control method and apparatus of a throttle valve for feedback controlling a position of the throttle valve.

In position control of an electronic controlled throttle, a technique for improving position resolution of a throttle valve has conventionally been used in order to control an idling rotational speed so as to become a constant speed. According to the position control, a position of the throttle valve detected by a sensor is converted into a digital value by an A/D converter constructed by a microcomputer, and a motor is controlled by software by using PID control or the like so that an opening degree of the throttle valve coincides with a target value on the basis of a difference (hereinafter, referred to as a deviation) between the actual position and the target position of the throttle valve.

Therefore, if the user tries to finely move the throttle valve by 0.1 degree or the like, not only an influence of friction which is caused in rotary axes of the motor, a gear, and the valve but also an influence of friction of a brush in case of using a DC motor as a motor cannot be ignored. It takes a longer time until the opening degree of the throttle valve coincides with the target value than that in the case where the target position changes largely by tens of degrees or the like.

Therefore, in JP-A-10-47135 and JP-A-7-332136, there has been disclosed the technique such that the smaller the deviation between the position of the throttle valve and the target position is, the more a gain of the PID control is increased, or in the Official Gazette of international publication WO99/53182, there has been disclosed the technique of switching to a large correction coefficient at the time of micro opening degree control.

Further, in JP-A-10-238370 and JP-A-2001-73817, there has been disclosed the method whereby an integration term is controlled to a specific value (including a removal of the integration term) at a position near a switching position of action forces of a return spring and a default spring (a spring for limp-home condition of a vehicle) which act on the throttle valve.

Since resolution of the general A/D converter built in the microcomputer is up to 10 bits, an angle from a full closing state to a full open state of the valve is equal to about 90 degrees. Therefore, in case of performing the A/D conversion by 10 bits, the resolution of the position detection is equal to about 0.1 degree, and it is impossible to control at a precision of 0.1 degree. Therefore, in order to improve the resolution of the position detection only for a limited area near 10 degrees from the full closing state where control resolution corresponds to necessary idling rotational speed control, an output of the position sensor is transmitted through an amplifier of, for example, 4 times and A/D converted, thereby raising the resolution by two bits (refer to JP-A-6-101550).

A method of improving the resolution of the position detection by using a process after the A/D conversion by oversampling is also used.

SUMMARY OF THE INVENTION

However, according to the above methods, it is not easy to allow a throttle valve to precisely trace a microstep of a target position.

Features of the friction are that a magnitude of the friction at the time when the throttle valve is at rest and that of the friction at the time when the throttle valve is moving are different and a state of the friction changes suddenly, and it is likely to cause hunting according to an ordinary linear control system such as PID control or the like (FIG. 4 shows a concept of the friction in the case where a torque is applied to a resting valve and an opening degree is increased at a predetermined rate).

If the resting throttle valve is moved by increasing a control gain or the torque, the friction decreases suddenly and the valve exceeds the target position, so that a torque in the opposite direction has to be applied again.

It is, therefore, difficult to suppress the hunting according to the method of increasing the gain. There is also a problem such that the maximum value of stationary friction does not show reproducibility and a variation occurs in a response of the valve.

According to the method whereby the signal of the position sensor is amplified by the amplifier and the resolution of the A/D conversion is equivalently improved, there is a problem such that a degree of improvement of the resolution is smaller than a value which is expected from an amplification factor due to noises in environments of an automobile and, since there is a variation in amplification factor of the amplifier, a variation also occurs in a positional precision.

To improve the resolution by the oversampling, a condition that an average value of the A/D conversion corresponds to a signal level is necessary as a prerequisite. However, many A/D converters do not guarantee such correspondence.

Therefore, the resolution is not improved to a value larger than it is expected from the number of oversampling times. Since many A/D converting processes have to be executed within a time that is shorter enough than a position control period, there are problems such that a high speed A/D converter is necessary and a load factor of software of a microcomputer rises.

According to a method whereby in order to improve the control resolution, an intake pipe is worked (a bore is worked into a spherical shape) and sensitivity of an air flow rate to the position of the throttle valve is reduced, or an A/D converter of high resolution is used, or the like, there is a problem such that costs are high.

Even if any one of the foregoing conventional methods is used, although the position resolution of the throttle valve or the control resolution of the air flow rate can be improved to a certain degree, it is difficult to perfectly prevent the hunting of the throttle valve which is caused by a dead zone such as friction or the like and it is also difficult to assure the reproducibility of the response.

The hunting of the throttle valve or the operation without reproducibility (operation influenced by an aging change) exercises an adverse influence on the engine control as well as idling rotational speed control. The hunting also has a problem such that rotational portions of the throttle such as motor, position sensor, and the like are abraded and causes an aging change.

It is an object of the invention to provide control method and apparatus of a throttle valve, which can solve the problems of the conventional techniques as mentioned above.

Another object of the invention is to provide control method and apparatus of a throttle valve which can prevent a hunting of the throttle valve and improve resolution of position control with good reproducibility (without being influenced by an aging change).

To accomplish the above object, according to the invention, fundamentally, when a deviation between the actual position of the throttle valve and the target position approaches a predetermined value, the same value as a previous output value is outputted as a control output. The predetermined value of the deviation is, preferably, set to an upper limit value of 0.1 degree as an angle which is required for control of the throttle valve in idling rotational speed control.

When the invention is considered from another viewpoint, when the deviation between the actual position of the throttle valve and the target position approaches the predetermined value, an arithmetic operation of an integration term in an arithmetic operation of the control output is stopped.

Further, when the deviation between the actual position of the throttle valve and the target position approaches the predetermined value, a value according to a force of a spring is outputted as a control output.

According to one aspect of the invention, the above method is realized by a control apparatus of a throttle valve, comprising:

a throttle valve position detecting unit for detecting a position of the throttle valve;

a throttle valve driving unit for rotating or moving the throttle valve up to a predetermined position in response to an input signal;

a target throttle position calculating unit for calculating a target position of the throttle valve in accordance with a depression amount of an acceleration pedal depressed by the driver;

a throttle valve position deviation calculating unit for calculating a position deviation by comparing the target position of the throttle valve with an actual position of the throttle valve; and a control calculating unit for calculating a control signal for rotating or moving the throttle valve at predetermined timing so as to reduce the position deviation and supplying the control signal to the throttle valve driving unit, wherein the control calculating unit monitors an absolute value of the position deviation, stops the calculation of the control signal when the absolute value is equal to or less than a predetermined value, holds the signal supplied to the throttle valve driving unit at that time point to thereby fix an output, again calculates the control signal corresponding to a magnitude of the position deviation when the absolute value of the position deviation exceeds the predetermined value, and supplies the signal for reducing the position deviation to the throttle valve driving unit.

According to another aspect of the invention, there is provided a control apparatus comprising:

a throttle valve position detecting unit for detecting a position of the throttle valve;

a throttle valve driving unit for rotating or moving the throttle valve up to a predetermined position in response to an input signal;

a target throttle position calculating unit for calculating a target position of the throttle valve in accordance with a depression amount of an acceleration pedal depressed by the driver;

a throttle valve position deviation calculating unit for calculating a position deviation by comparing the target position of the throttle valve with an actual position of the throttle valve;

an integration value calculating unit for integrating an amount obtained by multiplying the position deviation by a predetermined value and inputting an integration value to the throttle valve driving unit; and an integration value setting unit, wherein the integration value setting unit changes the integration value calculated by the integration value calculating unit in accordance with at least one of the position deviation and the target position of the throttle valve.

Other objects, features and advantages of the invention will become apparent from the following description of the embodiments of the invention taken in conjunction with the accompanying drawings.

BRIEF DESCRIPTION OF THE DRAWINGS

FIG. 10 is a constructional diagram of a position control apparatus of the throttle valve according to the invention;

FIGS. 11A and 11B are conceptual diagrams showing a position and a duty at the time when a hunting occurs in the throttle valve;

FIGS. 14A and 14B are conceptual diagrams showing a position and a duty at the time when there is no reproducibility in the operation of the throttle valve;

FIGS. 15A and 15B are conceptual diagrams showing a position and a duty at the time when the reproducibility of the operation of the throttle valve is improved by using the invention.

DETAILED DESCRIPTION OF THE EMBODIMENTS

Figure 1:
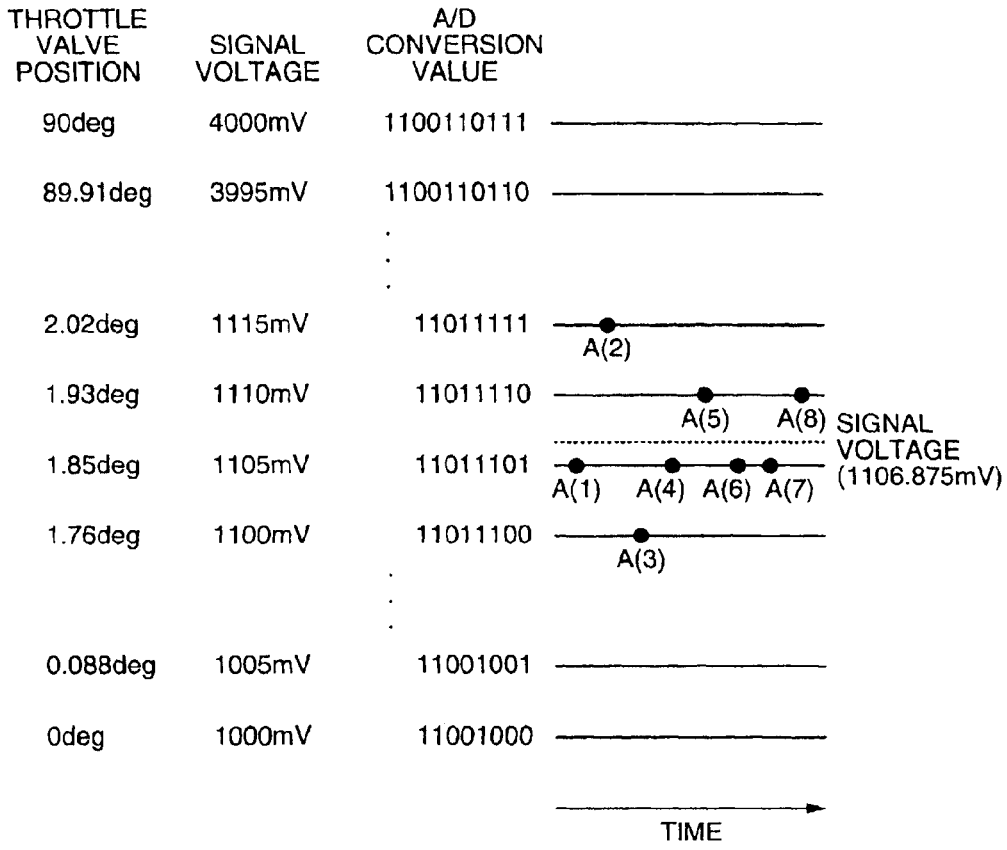
FIG. 1 is a conceptual diagram showing an oversampling method.

Embodiments of the invention will now be described with reference to the drawings.

In the diagrams, the portions having the same functions are designated by the same reference numerals and their overlapped explanation is omitted.

A throttle valve to control an intake air flow rate to an engine is constructed as so called an electronic controlled throttle apparatus such that an optimum air flow rate is obtained by a microcomputer (hereinafter, referred to as a "micom") from a position of an acceleration pedal and an operating mode and the throttle valve is controlled to an optimum position by a motor.

However, a relation between an air flow rate necessary for obtaining a torque which is required by an accelerating operation of the driver and an air flow rate for obtaining a torque which is actually necessary by an engine changes in dependence on the operating mode of the engine and is not always constant. For example, in a cylinder injection type engine which intends to reduce a fuel economy, since combustion methods of a homogeneous combustion and a stratified charge combustion are switched in accordance with the operating mode, a difference occurs in a requested air flow rate to a depression amount of the acceleration pedal due to a difference between both combustion methods. Even in case of a port injection engine, when the throttle valve functions as an idle control valve or an auto-cruise apparatus, fine control which cannot be adjusted by the depression amount of the acceleration pedal is required.

The position control of the electronic controlled throttle intends to allow the position of the throttle valve to coincide with a target position and feedback control based on a deviation between the actual position and the target position is used. Upon running, a response speed which is almost equivalent to that of a mechanical type throttle valve is necessary so that the driver does not feel a sense of wrongness of acceleration and deceleration. Upon idling, the air flow rate has to be adjusted by using the throttle valve at a precision which is almost equivalent to that of a conventional bypass valve for the idling rotational speed control. Therefore, as position control of the throttle valve, high resolution of 0.1 degree or less, for example, 0.05 degree is necessary. Naturally, it is also important that the air flow rate can be controlled by the same characteristics for a long period of time without causing reproducibility of the valve operation, that is, an aging change (for example, due to a change in friction of a mechanical portion, a change in spring characteristics, or the like).

FIG. 1 shows a concept of the conventional oversampling. A range from a full closing state (0 degree) to a full open state (90 degrees) of the throttle valve corresponds to a range from 1V to 4V of a position sensor. When an input range of an A/D converter is equal to a range from 0V to 5V, one bit of the A/D converter of 10 bits is equal to about 0.088 degree. However, since it corresponds to 5 mV as a voltage, at a bit near the least significant bit (LSB), an influence of the noises is large and resolution deteriorates. Therefore, as shown in FIG. 1, for example, the sampling operation by the A/D converter is executed continuously eight times, and an average value of eight data obtained is used as a true sensor output. According to this method, the resolution is formally raised by a level of three bits by the oversampling operations of eight times.

Figure 2:
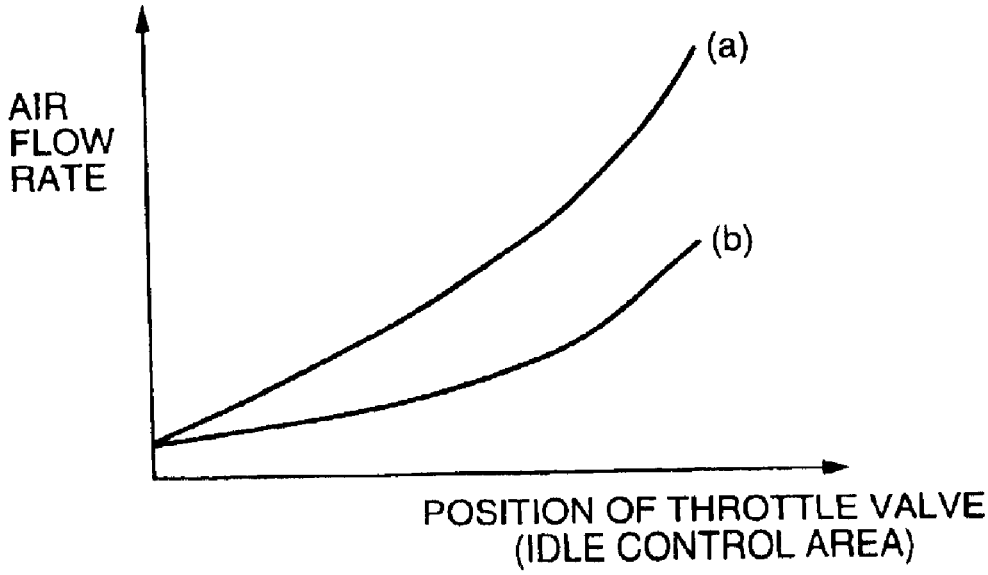
FIG. 2 is a relational diagram of a position of a throttle valve and an air flow rate.
Figure 3:
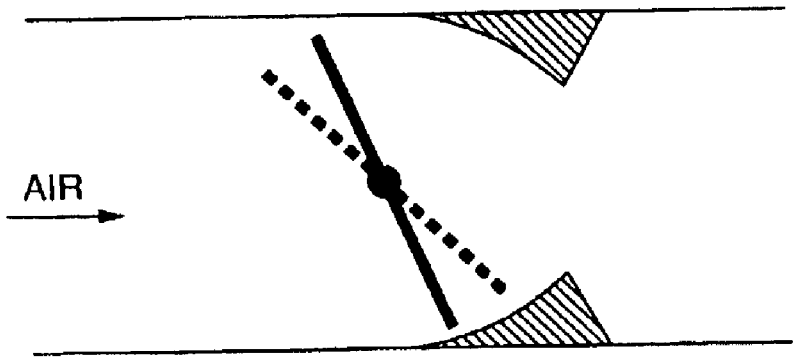
FIG. 3 is a conceptual diagram showing a method of reducing sensitivity of the air flow rate to the position of the throttle valve by working an intake pipe.
Figure 4:
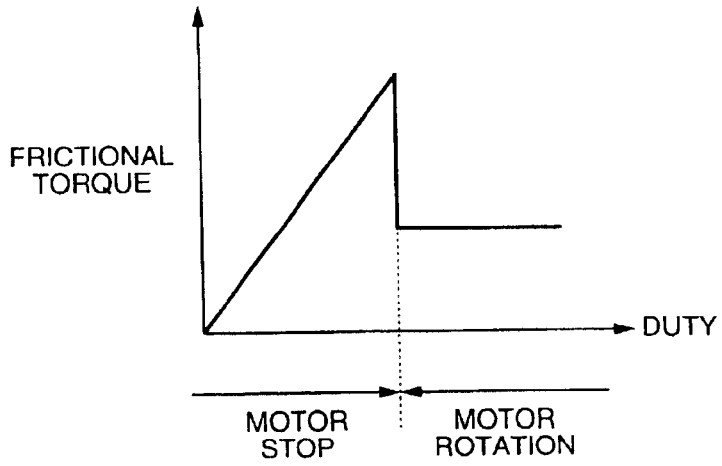
FIG. 4 is a conceptual diagram showing the operation of friction of the throttle valve.

As shown in FIG. 2, if the sensitivity of the air flow rate to the position of the throttle valve can be reduced from (a) to (b), an effect similar to the improvement of the position detecting resolution is obtained. For example, as shown in FIG. 3, there is a method of changing a shape of the intake pipe along an orbit of the valve so that an opening area does not increase suddenly at a position near the full closing state of the throttle valve even if the valve is opened. Differences between those conventional techniques and the embodiment will be described hereinbelow.

Figure 5:
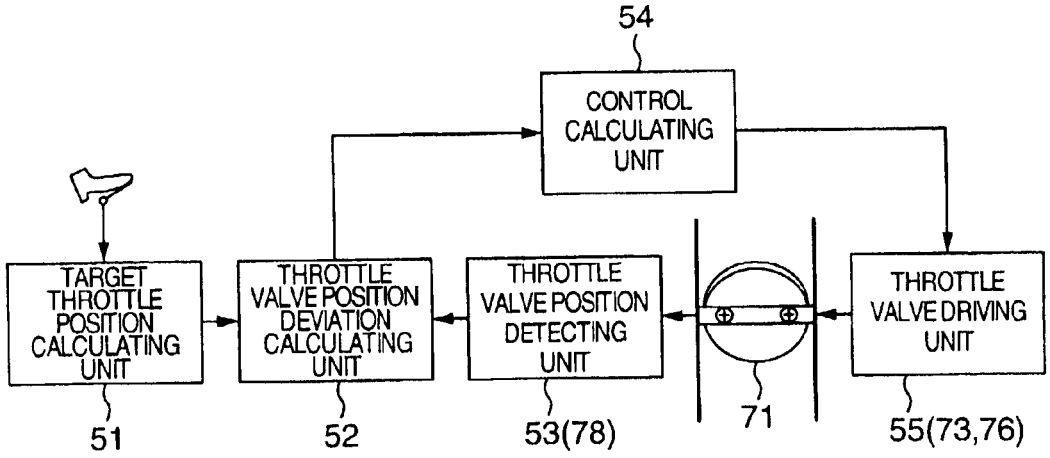
FIG. 5 is a first constructional diagram of a control apparatus of the throttle valve according to the invention.

FIG. 5 is a block diagram showing a construction of a control apparatus of the throttle valve according to the embodiment of the invention. In the construction of FIG. 5, the control apparatus of the throttle valve comprises: a throttle valve position detecting unit 53 (78) for detecting a position of the throttle valve; a throttle valve driving unit 55 (73, 76) for rotating or moving the throttle valve up to a predetermined position in response to an input signal; a target throttle position calculating unit 51 for calculating a target position of the throttle valve in accordance with a depression amount of an acceleration pedal depressed by the driver; a throttle valve position deviation calculating unit 52 for calculating a position deviation by comparing the target position of the throttle valve with an actual position of the throttle valve; and a control calculating unit 54 for calculating a control signal for rotating or moving the throttle valve at predetermined timing so as to reduce the position deviation and supplying the control signal to the throttle valve driving unit, wherein the control calculating unit monitors an absolute value of the position deviation, stops the calculation of the control signal when the absolute value is equal to or less than a predetermined value, holds the signal supplied to the throttle valve driving unit at that time point to thereby fix an output, again calculates the control signal corresponding to a magnitude of the position deviation when the absolute value of the position deviation exceeds the predetermined value, and supplies the signal for reducing the position deviation to the throttle valve driving unit.

Figure 7:
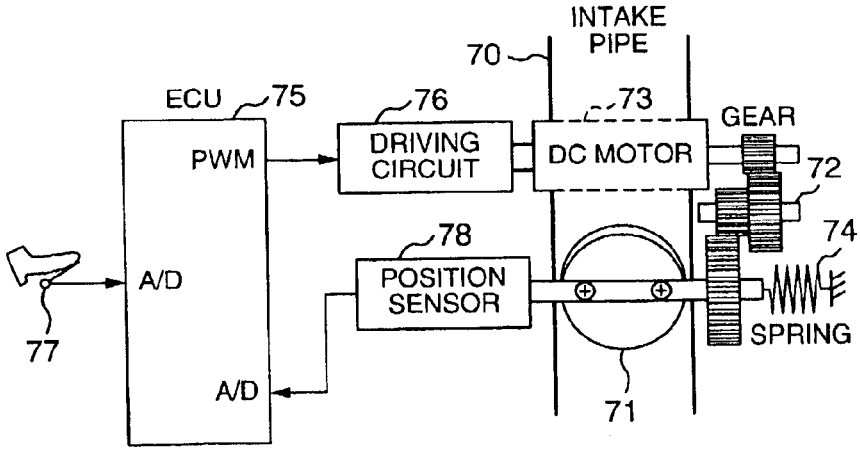
FIG. 7 is a first constructional diagram of an electronic controlled throttle according to an embodiment of the invention.

FIG. 7 shows an example of a construction of an control apparatus of the throttle valve according to an embodiment of the invention and corresponds to FIG. 5. A throttle valve 71 provided in an intake pipe 70 is a butterfly valve and driven by a DC motor 73 via a reduction gear 72. The throttle valve 71 properly adjusts the air which flows from an air cleaner (not shown) and supplies it to an engine (also not shown). A spring 74 attached to a rotary axis of the throttle valve 71 has been designed in a manner such that unless the motor generates a torque, the throttle valve is returned to a predetermined position. Thus, there is realized a fail-safe function such that even if an engine control unit (hereinafter, abbreviated to an ECU) 75 detects an abnormality and makes a motor driving circuit 76 inoperative, a predetermined air flow rate is assured, the engine does not stop, a rotational speed does not rise abnormally, and a vehicle can run up to a nearest repair shop or the like. The ECU 75 has the calculating units 52 and 54 in FIG. 5 and A/D converts a signal from a position sensor 77 of the acceleration pedal and a signal from a position sensor 78 of the throttle valve into digital signals. Subsequently, the ECU 75 obtains the target position of the throttle valve in accordance with the operating mode of the engine and calculates a signal to be supplied to the driving circuit on the basis of a difference (deviation) between the obtained target position and the measured position of the throttle valve by using feedback control such as PID control or the like so as to reduce the deviation. This signal is sent as a PWM signal to the driving circuit. The driving circuit amplifies the PWM signal and drives the motor.

Figure 8:
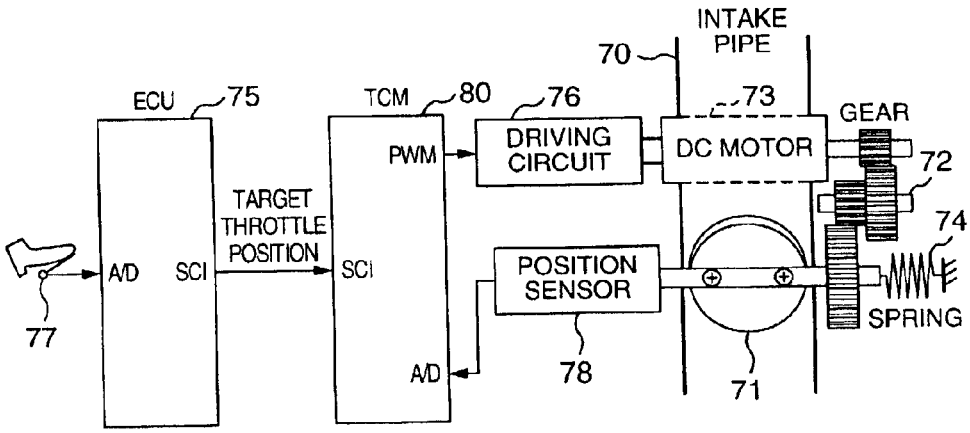
FIG. 8 is a second constructional diagram of the electronic controlled throttle according to the embodiment of the invention.

FIG. 8 shows a construction of the control apparatus of the throttle valve different from that of FIG. 7. Unlike the construction of FIG. 7, in addition to the ECU 75 for controlling the engine, a control unit (hereinafter, abbreviated to a TCU) 80 for mainly moving the throttle is added. The ECU 75 A/D converts the signal from the position sensor 77 of the acceleration pedal into the digital signal, obtains the target position of the throttle valve in accordance with the operating mode of the engine, and transfers it to the TCU 80 by serial communication. The TCU 80 A/D converts the signal from the position sensor 78 of the throttle valve into the digital signal and outputs it as a PWM signal of a duty ratio such that actual position coincides with the target position of the throttle valve. The TCU 80 transfers it to the driving circuit 76 and the driving circuit 76 amplifies the PWM signal and drives the motor in a manner similar to that in the construction of FIG. 7.

Figure 9:
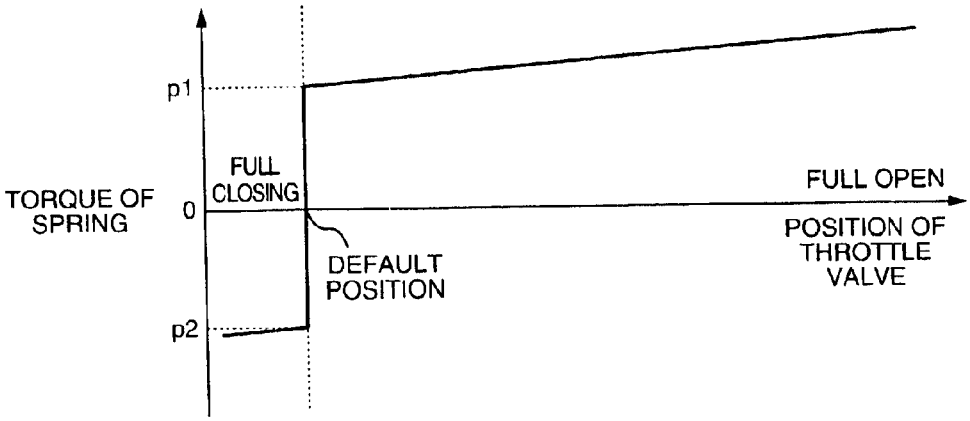
FIG. 9 is a relational diagram of the position of the throttle valve and a torque of a spring.

FIG. 9 shows characteristics of the spring attached to the rotary axis of the throttle valve. A preload has been set to the spring. A sign of a torque which is applied to the throttle valve is inverted from a default position as a boundary. As the position of the throttle valve is away from the default position, the torque increases. Fundamentally, the torque of the preload occupies almost of the torque which is applied by the spring. To allow the throttle valve to be resting at a specific position, it is necessary generate a torque matched with the spring. When the throttle valve is finely moved by 0.1 degree or the like in a specific range by the idling rotational speed control or the like, the torque necessary for the motor is almost constant if excluding a transient state of the response.

Figure 6:
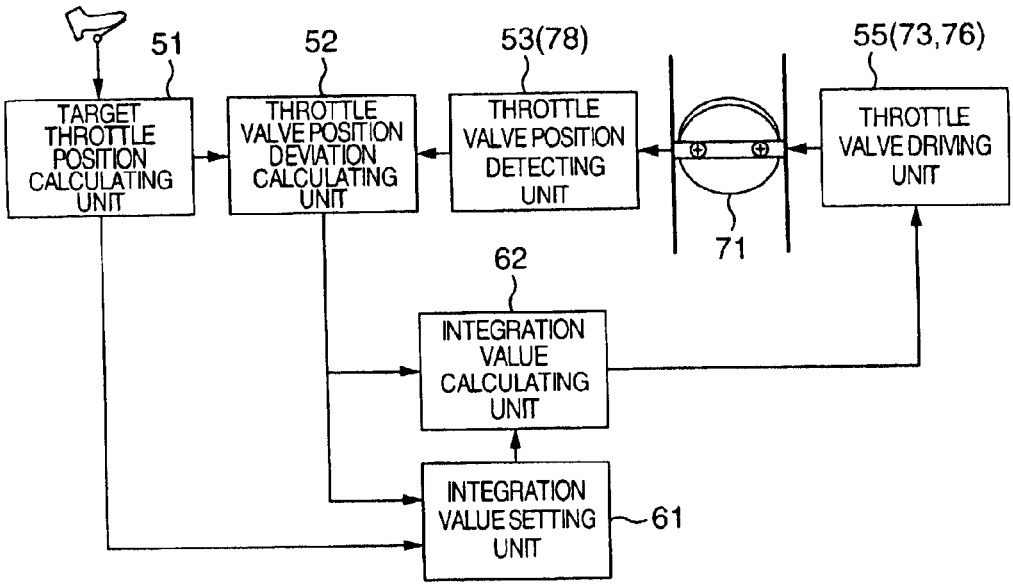
FIG. 6 is a second constructional diagram of the control apparatus of the throttle valve according to the invention.

FIG. 6 is a block diagram showing an example of a construction of a throttle valve control apparatus of the invention.

In the construction of FIG. 6, the control apparatus of the throttle valve comprises: the throttle valve position detecting unit 53 (78) for detecting a position of the throttle valve; the throttle valve driving unit 55 (73, 76) for rotating or moving the throttle valve up to a predetermined position in response to an input signal; the target throttle position calculating unit 51 for calculating a target position of the throttle valve in accordance with a depression amount of an acceleration pedal depressed by the driver; the throttle valve position deviation calculating unit 52 for calculating a position deviation by comparing the target position of the throttle valve with an actual position of the throttle valve; an integration value calculating unit 62 for integrating an amount obtained by multiplying the position deviation by a predetermined value and inputting an integration value to the throttle valve driving unit 55; and an integration value setting unit 61, wherein the integration value setting unit 61 changes the integration value calculated by the integration value calculating unit 62 in accordance with at least one of the position deviation and the target position of the throttle valve.

FIG. 10 is a block diagram showing another example of a construction of the position control apparatus of the throttle valve and corresponds to FIG. 6. The PID control is used as position control. According to this control, a duty ratio of the PWM which is inputted to the driving circuit of the motor is calculated so that the target position coincides with the position measured by the position sensor. A proportional amount, an integration, and a differentiation of a deviation between the target position value and the measured value are calculated, respectively, and the sum of them is used as a duty ratio of the PWM. When considering behavior of the control at the time when the target throttle position changes by about 0.1 degree, since the deviation is fundamentally small, the proportional amount is almost equal to 0. Since a speed of the valve is not high, the differentiation is also almost equal to 0. It is, however, necessary to hold the throttle valve to an almost predetermined position. The duty ratio of the PWM is equal to the value corresponding to the torque of the spring. In this case, therefore, most of the duty ratio is shared by the integration.

Details of a position control method of the throttle valve will be described hereinbelow. First, a method of preventing the hunting of the throttle valve and, subsequently, a method of making the valve operative with high reproducibility will be described.

FIGS. 11A and 11B conceptually show the position of the throttle valve at the time when the conventional position control of the throttle valve is used and the duty of the PWM signal which is applied to the driving circuit and in the case where the hunting occurs. When the throttle valve approaches a target value and the speed of the valve decreases, an influence of the friction increases and the throttle valve does not coincide with the target value but is at rest. At this time, the torque of the motor becomes equal to the torque including not only the torque of the spring but also the friction. Since the deviation is not equal to 0, although the integration value increases with the elapse of time by the integration calculation, since stationary friction also increases in accordance with the torque of the motor, the throttle valve is held at rest. When the torque of the motor exceeds the maximum value of the stationary friction, it enters an area of dynamic friction and the friction decreases suddenly, so that the throttle valve moves over the target value. In the control, since the sign of the deviation is inverted, the integration value starts to decrease. However, the throttle valve does not coincide with the target but is at rest again. As for the response of the throttle valve to the microstep operation of the target position, the hunting occurs in the repetition of such an operation.

Figures 12A, 12B:
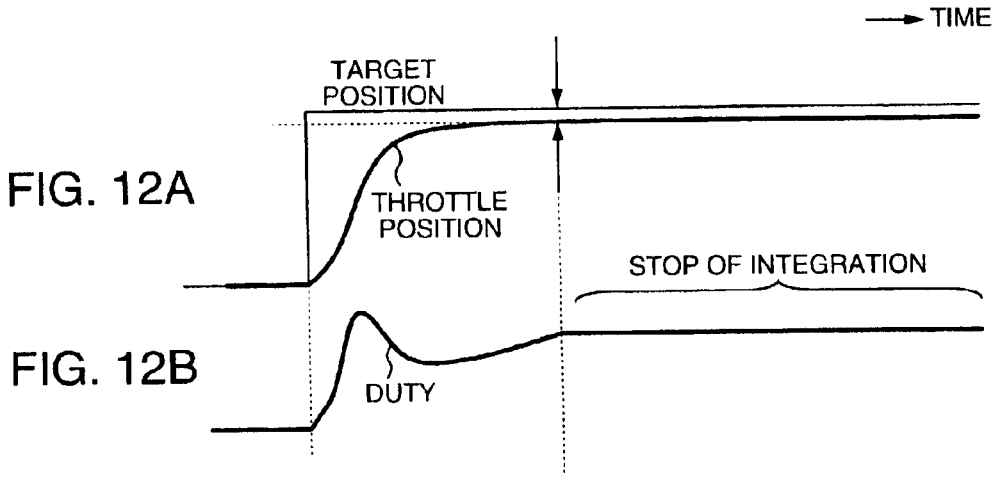
FIGS. 12A and 12B are conceptual diagrams showing a position and a duty at the time when the hunting of the throttle valve is suppressed by using the invention.

Therefore, as shown in FIGS. 12A and 12B, when the throttle valve approaches the target value and the absolute value of the deviation is lower than a predetermined value, the calculation of the integration is stopped, the throttle valve is allowed to be at rest, and the duty ratio of the PWM which is applied to the motor is also fixed. Thus, although the deviation is slightly left, the hunting of the throttle valve can be avoided. In the block diagram of FIG. 10, although the integration calculation appears clearly because the PID is used for the position control, the integration calculation is not clear but is also realized on software as a part of a digital filter in accordance with the control. However, in servo control which intends to trace the target value, the integration calculation is equivalently executed as a digital filter. In case of using such control, a similar effect can be obtained by stopping the calculation of the digital filter corresponding to the integration. When the absolute value of the deviation exceeds a predetermined range because the target value changes or the like, the integration calculation is restarted, thereby enabling the throttle valve to trace the target value.

Figure 13:
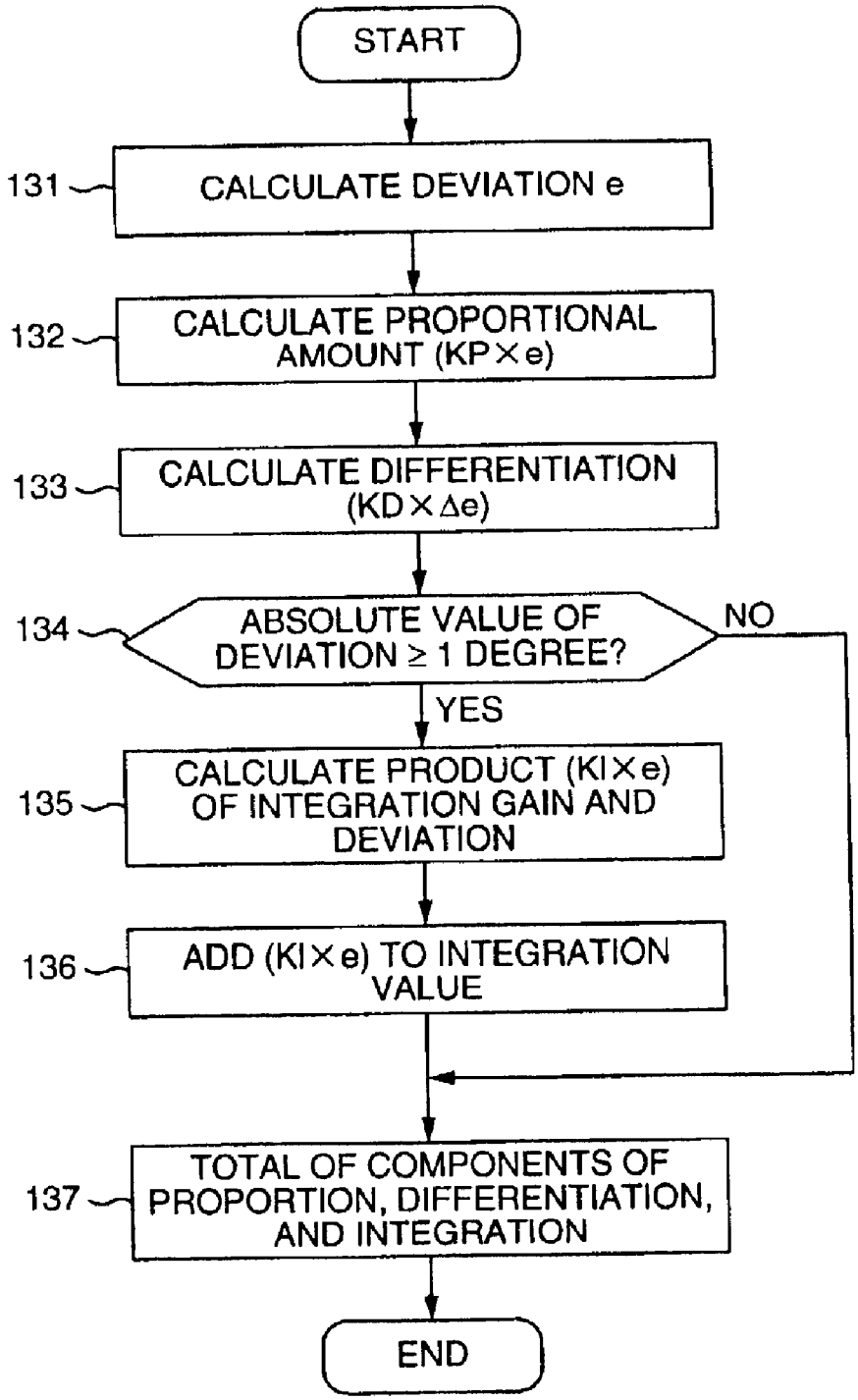
FIG. 13 is a flowchart showing a first process of the invention.

The process contents of the above-described methods are summarized in a flowchart of FIG. 13. This calculation is executed every predetermined period of 2 msec or the like. In step 131, the deviation between the position of the throttle valve measured by the position sensor and the target position is calculated. In step 132, the deviation is multiplied by a proportional gain, thereby obtaining a proportional amount. In step 133, a difference of the deviations is multiplied by a differentiation gain. In step 134, the absolute value of the deviation is evaluated. For example, if it is equal to or less than 1 degree, the calculation of the integration is not performed but step 137 follows. If it is smaller than 1 degree, in step 135, the deviation is multiplied by an integration gain. In step 136, a multiplication result of step 135 is added to the previous integration value. In step 137, components of the proportion, differentiation, and integration calculated as mentioned above are summed, thereby obtaining a duty of the PWM. When the absolute value of the deviation is equal to or less than 1 degree, the previous integration value is used as an integration value which is added.

A method of allowing the response of the throttle valve to the microstep operation of the target position to have reproducibility will now be described. FIGS. 14A and 14B conceptually show the value of throttle valve and the duty of the PWM signal which is supplied to the driving circuit at the time when the position control of the throttle valve for suppressing the hunting mentioned above is used. There is no reproducibility in the response of the throttle valve to the target value. A step width of the target value is equal to a microwidth such as 0.1 degree or the like. When there is no friction, the torque of the motor and that of the spring are matched ideally and a reference value of the torque (duty ratio) at which the throttle position is held is considered to be constant. The torque in the rest state corresponds to the integration value of the position control. However, since there is actually friction in the rotary portion and there is a variation in magnitude of the friction, the duty ratio at the time when the throttle valve approaches the target value does not coincide with the reference value but is set to a different value every time. Therefore, since a variation also occurs in the integration value which is held, when the target value changes, naturally, the integration calculation is started every time from a different integration value. When the valve starts to rotate, since the friction decreases suddenly, the operation of the valve changes in dependence on a magnitude of the held duty ratio. This is because even if the control gain is adjusted while including the friction, no consideration is taken up to the variation. Assuming that the torque of the spring acts in the direction of closing the valve, when the held value of the duty ratio is smaller than the reference value which is matched with the spring without friction, a response time of the valve becomes long. When the held value is larger than the reference value, overshooting occurs in the response of the valve. To solve the above drawback, it is sufficient to reset the held integration value to the reference value when a command value changes as shown in FIGS. 15A and 15B. By this method, the integration calculation is started from the reference value set to the same value in each step response, and the reproducibility of the response is improved. Although the method of stopping the integration under the foregoing predetermined conditions and the method of setting the integration value to the predetermined value can be used in common as described above, each effect can be obtained even if they are separately used.

Figure 16:
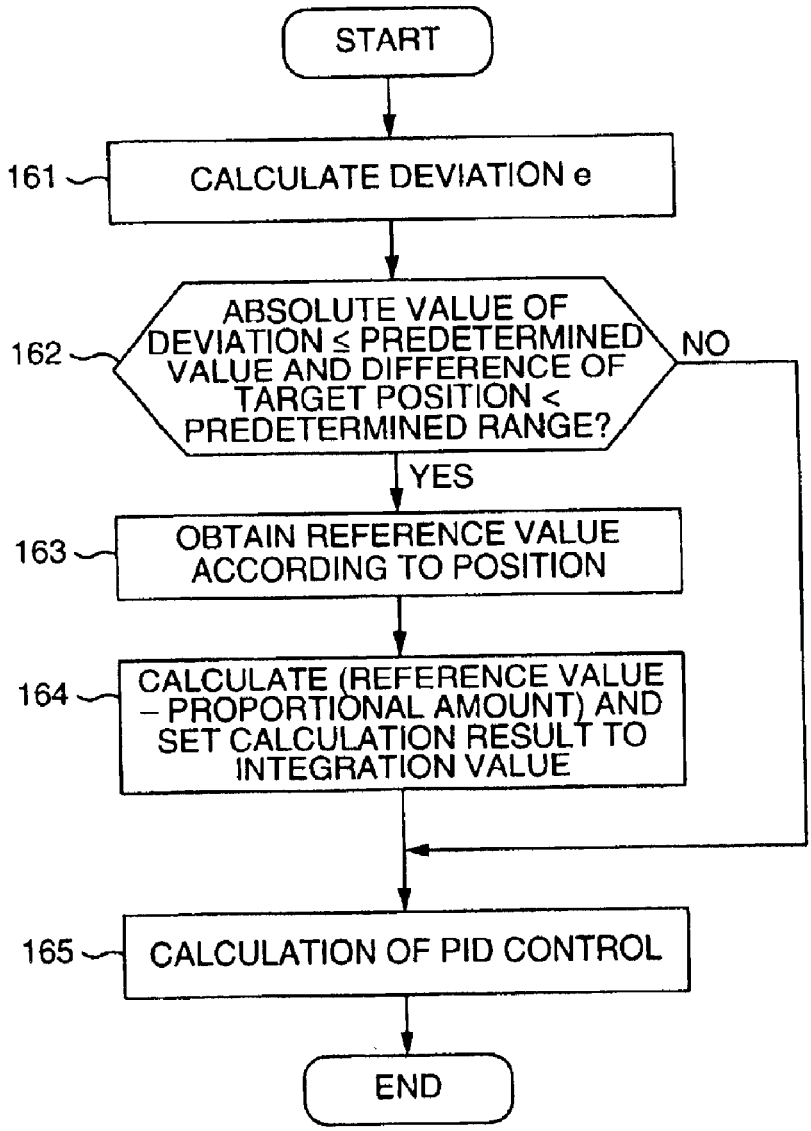
FIG. 16 is a flowchart showing a second process of the invention.

The process contents of the above-described methods are summarized in a flowchart of FIG. 16. This calculation is executed every predetermined period of 2 msec or the like. In step 161, the deviation between the between the position of the throttle valve measured by the position sensor and the target position is calculated. In step 162, whether the absolute value of the deviation is equal to or less than a predetermined value and a difference of the target values lies within a predetermined range or not is evaluated. That is, timing when the target value changes in a microstep shape from the rest state of the valve is detected. When the change in target value is not a microchange, since there is no need to reset the integration value, the processing routine advances to step 165. When the target value changes in the microstep shape from the rest state, a duty ratio (reference value) which is ideally matched with the spring and corresponds to the position of the throttle valve is obtained in step 163. Since the dynamic friction has the high reproducibility and can be easily measured, such a reference value can be also set to the duty ratio matched with the spring including the dynamic friction. In this case, since the sign of the dynamic friction changes in dependence on the changing direction of the target value, it is necessary to also calculate the reference value in correspondence to it. In step 164, since the deviation is not equal to 0 from the duty ratio corresponding to the reference value, an integration value to be set is obtained by subtracting a slight proportional amount which remains. In step 165, the calculation of the ordinary position control such as PID control or the like is executed.

The second embodiment of the invention shown in FIG. 6 will now be supplementally explained.

In the second embodiment, when the absolute value of the position deviation is equal to or less than the predetermined value, in order to prevent the hunting due to a dead zone such as friction or the like, it is also possible to construct in a manner such that the integration value setting unit stops the integration calculation in the integration value calculating unit, holds the integration value, and restarts the integration calculation when the absolute value of the position deviation exceeds the predetermined value.

Further, in the second embodiment, when the absolute value of the position deviation is equal to or less than the predetermined value and the target throttle position changes at a predetermined rate or more, or when the absolute value of the position deviation exceeds the predetermined value, the integration value can be also set to a predetermined value by the integration value setting unit. As a value which is set to the integration value, it is also possible to preliminarily use a value corresponding to a state where the throttle valve is ideally at rest at the target throttle position different from the current throttle position without being influenced by friction or the like which is not presumed. It is also possible to preliminarily use a value corresponding to a state where the throttle valve is ideally at rest at the current throttle position without being influenced by friction or the like which is not presumed.

According to the control apparatus of the throttle valve of the invention, in the position control for allowing the throttle valve to coincide with the target position, as for a microchange of the target value, the hunting of the valve is prevented and the position resolution can be improved. As for a microchange of the target value, the reproducibility of the response of the valve can be raised. Thus, performance of the engine control such as idling rotational speed control or the like can be improved. Since there is no need to work the intake pipe or the like in order to reduce the sensitivity of the air flow rate to the throttle position, it is advantageous also from a viewpoint of costs.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A method of controlling a throttle valve by a motor, when a deviation between an actual position and a target position of said throttle valve approaches a predetermined value, one of the following steps a) and b) is executed:

a) a same value as a previous output value is outputted as a control output; and b) an arithmetic operation of an integration term in an arithmetic operation of the control output is stopped.

2. A method according to claim 1, wherein an upper limit of said predetermined value is set to 0.1 degree as an angle.

3. A control apparatus of a throttle valve, comprising:

a throttle valve position detecting unit for detecting a position of said throttle valve;

a throttle valve driving unit for rotating or moving said throttle valve up to a predetermined position in response to an input signal;

a target throttle position calculating unit for calculating a target position of the throttle valve in accordance with a depression amount of an acceleration pedal depressed by the driver;

a throttle valve position deviation calculating unit for calculating a position deviation by comparing said target position of the throttle valve with an actual position of the throttle valve; and a control calculating unit for calculating a control signal for rotating or moving said throttle valve at predetermined timing so as to reduce the position deviation and supplying said control signal to said throttle valve driving unit, wherein said control calculating unit monitors an absolute value of the position deviation, stops the calculation of the control signal when said absolute value is equal to or less than a predetermined value, holds said signal supplied to said throttle valve driving unit at that time point to thereby fix an output, again calculates the control signal corresponding to a magnitude of the position deviation when the absolute value of said position deviation exceeds the predetermined value, and supplies the signal for reducing the position deviation to said throttle valve driving unit.

4. A control apparatus of a throttle valve, comprising:

a throttle valve position detecting unit for detecting a position of said throttle valve;

a throttle valve driving unit for rotating or moving said throttle valve up to a predetermined position in response to an input signal;

a target throttle position calculating unit for calculating a target position of the throttle valve in accordance with a depression amount of an acceleration pedal depressed by the driver;

a throttle valve position deviation calculating unit for calculating a position deviation by comparing said target position of the throttle valve with an actual position of the throttle valve;

an integration value calculating unit for integrating an amount obtained by multiplying the position deviation by a predetermined value and inputting an integration value to the throttle valve driving unit; and an integration value setting unit, wherein said integration value setting unit changes the integration value calculated by said integration value calculating unit in accordance with at least one of the position deviation and the target position of the throttle valve.

5. An apparatus according to claim 4, wherein when an absolute value of the position deviation is equal to or less than a predetermined value, in order to prevent a hunting due to a dead zone such as friction or the like, said integration value setting unit stops the integration calculation in said integration value calculating unit, holds the integration value, and restarts the integration calculation when the absolute value of the position deviation exceeds the predetermined value.

6. An apparatus according to claim 4, wherein when an absolute value of the position deviation is equal to or less than a predetermined value and the target throttle position changes at a predetermined rate or more, or when the absolute value of the position deviation exceeds the predetermined value, said integration value setting unit sets a value corresponding to a state where the throttle valve is ideally at rest at the target throttle position different from a current throttle position without being influenced by friction or the like which is not presumed.

7. An apparatus according to claim 4, wherein when an absolute value of the position deviation is equal to or less than a predetermined value and the target throttle position changes at a predetermined rate or more, or when the absolute value of the position deviation exceeds the predetermined value, said integration value setting unit sets a value corresponding to a state where the throttle valve is ideally at rest at a current throttle position without being influenced by friction or the like which is not presumed.

* * * * *